US009414165B2

(12) United States Patent
Khenkin et al.

(10) Patent No.: US 9,414,165 B2
(45) Date of Patent: Aug. 9, 2016

(54) ACOUSTIC SENSOR RESONANT PEAK REDUCTION

(71) Applicant: Invensense, Inc., San Jose, CA (US)

(72) Inventors: Aleksey S. Khenkin, Nashua, NH (US); Baris Cagdaser, Sunnyvale, CA (US); James Christian Salvia, Redwood City, CA (US); Fariborz Assaderaghi, Emerald Hills, CA (US)

(73) Assignee: INVENSENSE, INC., San Jose, CA (US)

( * ) Notice: Subject to any disclaimer, the term of this patent is extended or adjusted under 35 U.S.C. 154(b) by 120 days.

(21) Appl. No.: 14/165,430

(22) Filed: Jan. 27, 2014

(65) Prior Publication Data

US 2015/0214912 A1 Jul. 30, 2015

(51) Int. Cl.

| | |
|---|---|
| ***H04R 3/00*** | (2006.01) |
| ***H04R 3/06*** | (2006.01) |
| *H04R 19/00* | (2006.01) |
| *H04R 19/04* | (2006.01) |

(52) U.S. Cl.

CPC ..... *H04R 3/06* (2013.01); *H04R 19/005* (2013.01); *H04R 19/04* (2013.01)

(58) Field of Classification Search

CPC ..... H04R 3/00; H04R 3/04; H04R 3/002
USPC ..... 381/111, 113, 102
See application file for complete search history.

(56) References Cited

U.S. PATENT DOCUMENTS

| | | | | |
|---|---|---|---|---|
| 4,689,818 | A * | 8/1987 | Ammitzboll | H04R 25/453 381/313 |
| 6,069,959 | A * | 5/2000 | Jones | G10K 11/1782 330/262 |
| 6,744,264 | B2 | 6/2004 | Gogoi et al. | |
| 7,155,979 | B2 | 1/2007 | Lasalandra et al. | |
| 2006/0049836 | A1 | 3/2006 | Morimoto et al. | |
| 2006/0126455 | A1 | 6/2006 | Ikeda | |
| 2009/0019933 | A1 | 1/2009 | Sung et al. | |
| 2011/0142261 | A1* | 6/2011 | Josefsson | H04R 3/00 381/107 |
| 2012/0105080 | A1 | 5/2012 | Iwasawa et al. | |
| 2013/0051582 | A1* | 2/2013 | Kropfitsch | H03F 1/56 381/111 |
| 2014/0064523 | A1* | 3/2014 | Kropfitsch | H03G 1/0094 381/174 |
| 2015/0146885 | A1* | 5/2015 | Fitzgerald | H04R 3/005 381/98 |

OTHER PUBLICATIONS

Seeger, et al., "Charge Control of Parallel-Plate Electrostatic Actuators and the Tip-In Instability", Journal of Microelectromechanical Systems, vol. 12, No. 5, Oct. 2003, 16 pages.
Office Action dated Dec. 18, 2014 for U.S. Appl. No. 13/720,984, 19 pages.
Final Office Action dated Apr. 16, 2015 for U.S. Appl. No. 13/720,984, 23 pages.

* cited by examiner

*Primary Examiner* — Disler Paul
(74) *Attorney, Agent, or Firm* — Amin, Turocy & Watson, LLP

(57) ABSTRACT

A MEMS acoustic sensor includes a transducer with a frequency response with a gain peak, and a peak reduction circuit with a frequency response and coupled to the transducer. The frequency response of the peak reduction circuit causes attenuation of the gain peak.

25 Claims, 4 Drawing Sheets

ACOUSTIC SENSOR RESONANT PEAK REDUCTION

BACKGROUND

Various embodiments of the invention relate generally to an acoustic sensor and particularly to the performance of the acoustic sensor.

Transducers of MEMS acoustic sensors have a frequency response with a gain peak that is quite steep relative to the remainder of the acoustic sensor's frequency response. Sounds or speech heard by a user of the MEMS acoustic sensor at frequencies of the gain peak or thereabout are unpleasant. An example of this unpleasantness is harshness of the voice. In some cases, the gain peak can degrade the intelligibility of speech that is recorded by the acoustic sensor, because it amplifies only the portions of the speech that are at frequencies substantially close to the gain peak. MEMS acoustic sensors employed in mobile devices, such as cell phones, exhibit additional unpleasant sounds because their gain peak shifts due to environmental changes. Another undesirable effect of high gain peak is noise amplification.

Therefore, the need arises for gain peak reduction in a higher performing MEMS acoustic sensor.

SUMMARY

Briefly, an embodiment of the invention includes a MEMS acoustic sensor having a transducer with a resonance frequency and a frequency response with a gain peak substantially at the resonance frequency, and a peak reduction circuit with a frequency response and coupled to the transducer. The frequency response of the peak reduction circuit causes attenuation of the gain peak.

A further understanding of the nature and the advantages of particular embodiments disclosed herein may be realized by reference of the remaining portions of the specification and the attached drawings.

DETAILED DESCRIPTION OF EMBODIMENTS

Figure 1:
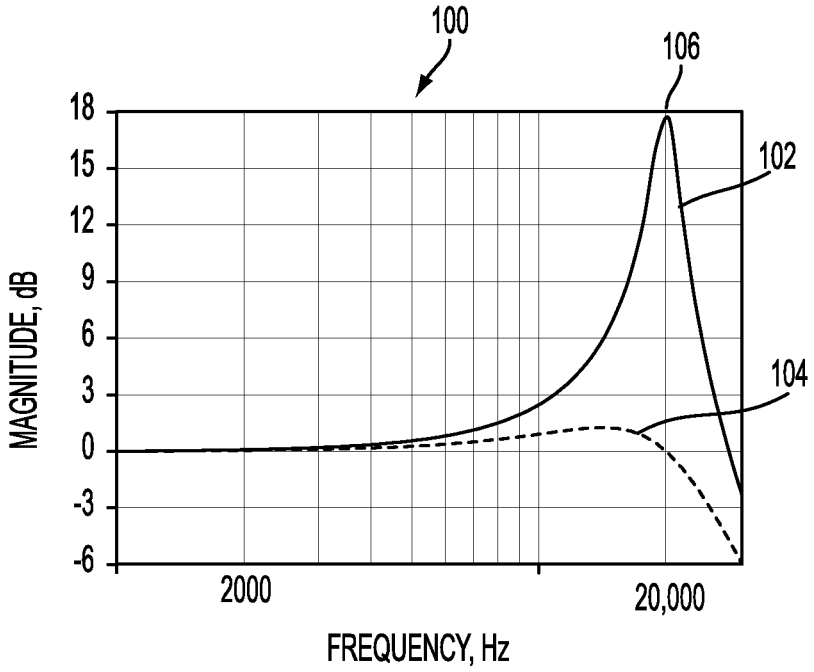
FIG. 1 shows a graph of the frequency response of a transducer of an acoustic sensor.

In the described embodiments Micro-Electro-Mechanical Systems (MEMS) refers to a class of structures or devices fabricated using semiconductor-like processes and exhibiting mechanical characteristics such as the ability to move or deform. MEMS often, but not always, interact with electrical signals. A MEMS device may refer to a semiconductor device implemented as a micro-electro-mechanical system. A MEMS device includes mechanical elements and optionally includes electronics for sensing. MEMS devices include but not limited to gyroscopes, accelerometers, magnetometers, acoustic sensors and radio-frequency components. In an embodiment, acoustic sensors can include microphone. Silicon wafers containing MEMS structures are referred to as MEMS wafers.

In the described embodiments, MEMS structure may refer to any feature that may be part of a larger MEMS device. One or more MEMS features comprising moveable elements is a MEMS structure. A structural layer may refer to the silicon layer with moveable structures. MEMS substrate provides mechanical support for the MEMS structure. The MEMS structural layer is attached to the MEMS substrate. The MEMS substrate is also referred to as handle substrate or handle wafer. In some embodiments, the handle substrate serves as a cap to the MEMS structure. A cap or a cover provides mechanical protection to the structural layer and optionally forms a portion of the enclosure. Standoff defines the vertical clearance between the structural layer and the IC substrate. Standoff may also provide electrical contact between the structural layer and the IC substrate. Standoff may also provide a seal that defines an enclosure. Integrated Circuit (IC) substrate may refer to a silicon substrate with electrical circuits, typically CMOS circuits. A cavity may refer to a recess in a substrate. An enclosure may refer to a fully enclosed volume typically surrounding the MEMS structure and typically formed by the IC substrate, structural layer, MEMS substrate, and the standoff seal ring. A port may be an opening through a substrate to expose the MEMS structure to the surrounding environment.

In the described embodiments, an engineered silicon-on-insulator (ESOI) wafer may refer to a SOI wafer with cavities beneath the silicon device layer or substrate. Chip includes at least one substrate typically formed from a semiconductor material. A single chip may be formed from multiple substrates, where the substrates are mechanically bonded to preserve the functionality. Multiple chip includes at least 2 substrates, wherein the 2 substrates are electrically connected, but do not require mechanical bonding. A package provides electrical connection between the bond pads on the chip to a metal lead that can be soldered to a PCB. A package typically comprises a substrate and a cover.

In the described embodiments, a cavity may refer to an opening or recession in a substrate wafer and enclosure may refer to a fully enclosed space. Post may be a vertical structure in the cavity of the MEMS device for mechanical support. Standoff may be a vertical structure providing electrical contact.

In the described embodiments, back cavity may refer to a partial enclosed cavity equalized to ambient pressure via Pressure Equalization Channels (PEC). In some embodiments, back cavity is also referred to as back chamber. A back cavity formed with in the CMOS-MEMS device can be referred to as integrated back cavity. Pressure equalization channel also referred to as leakage channels/paths are acoustic channels for low frequency or static pressure equalization of back cavity to ambient pressure.

In the described embodiments, perforations refer to acoustic openings for reducing air damping in moving plates. Acoustic port may be an opening for sensing the acoustic pressure. Acoustic barrier may be a structure that prevents acoustic pressure from reaching certain portions of the device. Linkage is a structure that provides compliant attachment to substrate through anchor. Extended acoustic gap can be created by step etching of post and creating a partial post overlap over PEC.

Referring now to FIG. 1, a graph 100 of the frequency response of a MEMS device transducer is shown. The graph 100 shows an x-axis representing frequency in Hertz (Hz) and a y-axis representing magnitude in decibels (dB). The frequency range shown in the graph 100 is generally from 1 kHz to 30 kHz and the range of the magnitude is generally from −6 dB to 18 dB. It is noted that these numbers are merely used as examples and are not in any way intended to limit the various embodiments of the invention.

Also shown in FIG. 1 is the curve 104 representing the frequency response of a MEMS device transducer when the gain peak 106 is attenuated.

In an embodiment of the invention, the frequency response of FIG. 1 is for a MEMS acoustic sensor transducer. In such embodiments, the curve 102 is representative of the frequency response experienced by prior art devices. As shown at the gain peak 106 around frequencies higher than 10 kHz, an amplitude gain of more than 10 dB is shown over frequencies other than that of the resonance peak. Such increased magnitude causes unpleasant sounds and unintelligibility of speech.

The curve 104, shown in FIG. 1, on the other hand, represents the desired response. It does not have a drastic gain peak, as does the curve 102, and shows a frequency response generally similar to that of a low pass filter. The following figures and related text show various embodiments, although not inclusive, of apparatus and methods for achieving the response of curve 104 or thereabouts in a MEMS device that by itself would exhibit a frequency response resembling that of the curve 102.

Figure 2:
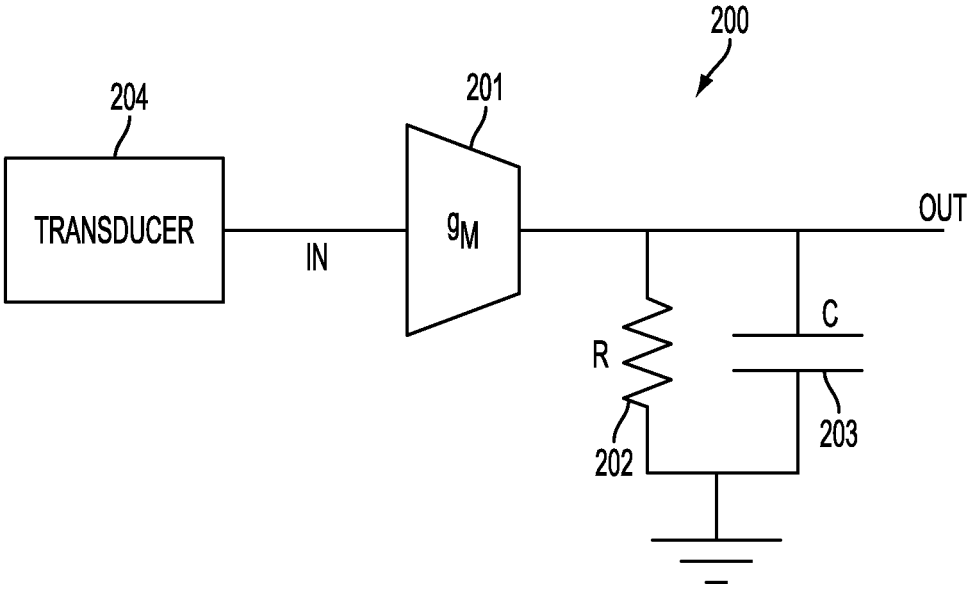
FIG. 2 shows an embodiment of peak reduction circuit employed by an acoustic sensor

FIG. 2 shows an embodiment of a peak reduction circuit 200 employed by a MEMS acoustic sensor. The peak reduction circuit 200 is made of analog and non-tunable circuits and is generally an amplifier with a low-pass frequency response. The amplifier 200 is shown to include a transconductance element 201 with a gain of $g_M$, shown coupled to a resistor 202 with resistance a' and a capacitor 203 with capacitance 'C.' The peak reduction circuit 200 of FIG. 2 is effectively an analog filter.

In operation, the stage 201 receives an input ("IN"), in the form of a voltage signal, and converts the same to a current signal, providing the current signal as input to the resistor 202 and capacitor 203. The input to stage 201 is generated by a transducer of a MEMS device 204. The transducer has a resonance frequency and a frequency response with a gain peak substantially at the resonance frequency. It is this gain peak, as shown by the gain peak 106, in FIG. 1, that is undesirable and need be reduced to avoid noise amplification, harsh and unpleasant sounds or speech.

The circuit 200 has a frequency response that causes attenuation of the gain peak. The total bandwidth of the peak reduction circuit 200 is $1/(2\pi RC)$. Reducing the bandwidth of the peak reduction circuit 200 below the resonance frequency of the transducer of the MEMS device by increasing either 'R' and/or 'C' has the effect of reducing the height of the gain peak of the transducer. The peak reduction circuit 200 is effectively an analog low pass filter that reduces the gain peak of the frequency response of the MEMS device transducer.

In another embodiment of the invention, the peak reduction circuit 200 may be a digital filter. Other examples of filters that may be coupled to the transducer to reduce the gain peak are bandpass filter, stop-band filter, adaptive filter, high-pass or any suitable filter that reduces the amplitude of the gain peak.

In the case of an adaptive filter, parameters of the filter, such as capacitance in analog filters and coefficients in digital filters, are adjusted. The parameters may be adjusted once, when the MEMS device is powered on, and remain fixed thereafter, or they may be adjusted periodically while the MEMS device is powered on, or they may be continuously adjusted during operation. Obviously, in the last case, environmental changes resulting in shifts of the gain peak can be better compensated for.

In some embodiments of the invention, the peak reduction circuit and the transducer are in a single package. In some embodiments of the invention, the peak reduction circuit and the transducer are in multiple packages. In other embodiments of the invention, the peak reduction circuit and the transducer are in a single chip. In some embodiments, the peak reduction circuit and the transducer are in multiple chips. As shown and discussed herein, in some embodiments of the invention, the peak reduction circuit is an analog circuit and in other embodiments, it is a digital circuit. The analog and/or digital circuits may be adaptive or not adaptive. In cases where the analog and/or digital circuits are adaptive, either or both may have the transducer and the analog/digital circuit may be in multiple chips or multiple packages or a single chip or a single package. In cases where the analog and/or digital circuits are non-adaptive, the transducer and the analog/digital circuit may be in multiple chips or a single package or a single chip or a single package.

Figure 3:
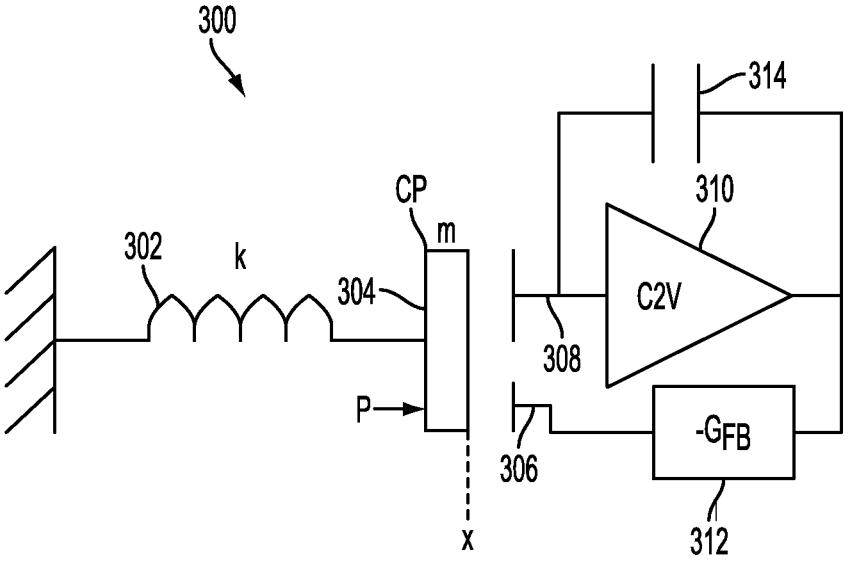
FIG. 3 shows conceptually an embodiment of a peak reduction circuit employed with an acoustic sensor.

FIG. 3 shows conceptually an embodiment of a peak reduction circuit 300 employed with a MEMS device. In an embodiment of the invention, the peak reduction circuit 300 is an active damping circuit. In the peak reduction circuit 300, the spring 302 with a spring constant 'k' and a moving electrode 304 with a mass 'm' together form a conceptual representation of a MEMS device.

The spring 302 is shown connected to a moving electrode 304 with a mass 'm', suspended on the spring 302 as to form a resonant mechanical system. Further shown in the active damping circuit 300 is a stationary electrode split into at least two parts, the sensing electrode 308, and the driving electrode 306. The sensing electrode 308 is shown coupled to a current-to-voltage (c2v) amplifier 310, which converts a current signal from the sensing electrode 308 to a voltage signal. The capacitor 314 is shown coupled to the input and output of the amplifier 310 as well as to a feedback control network 312.

The driving electrode 306 is responsive to feedback control network 312. The capacitor 314, feedback control network 312 and the amplifier 310 collectively form an active feedback loop. The feedback signal conditioning has a transfer function represented by '$-G_{FB}$'. The active feedback loop is used to apply a dampening force to the MEMS transducer around the resonant frequency of the transducer of the MEMS device to reduce the gain peak. The active feedback loop applies the damping force via the driving electrode 306.

For further details of the operation of active damping circuits, such as the one shown in FIG. 3, the reader is directed to U.S. patent application Ser. No. 13/720,984, filed on Dec. 19, 2012, and entitled "Mode Tuning Sense Interface", the disclosure of which is incorporated herein by reference as though set forth in full.

The feedback conditioning circuit 312 and the capacitor 314 in circuit 300 are tunable and, in this respect, peak reduction circuit 300 functions generally as an adaptive system, unlike the embodiment of FIG. 2, which is not tunable and therefore not adaptive.

In an exemplary embodiment of the invention, the MEMS device 302 is an acoustic sensor. In an embodiment where the MEMS device is an acoustic sensor, the adaptive characteristic of the circuit 300 compensates for the gain peak shift, such as air mass loading of the acoustic port in cell phone applications. Another way of estimating the shift in the gain peak is by use of a pilot test tone at a frequency near the gain peak with known relationship to the resonance frequency. The sensor's response to the pilot tone is tracked and where there is a shift in the gain peak, the sensor's response to the pilot tone should shift with it.

Figure 4:
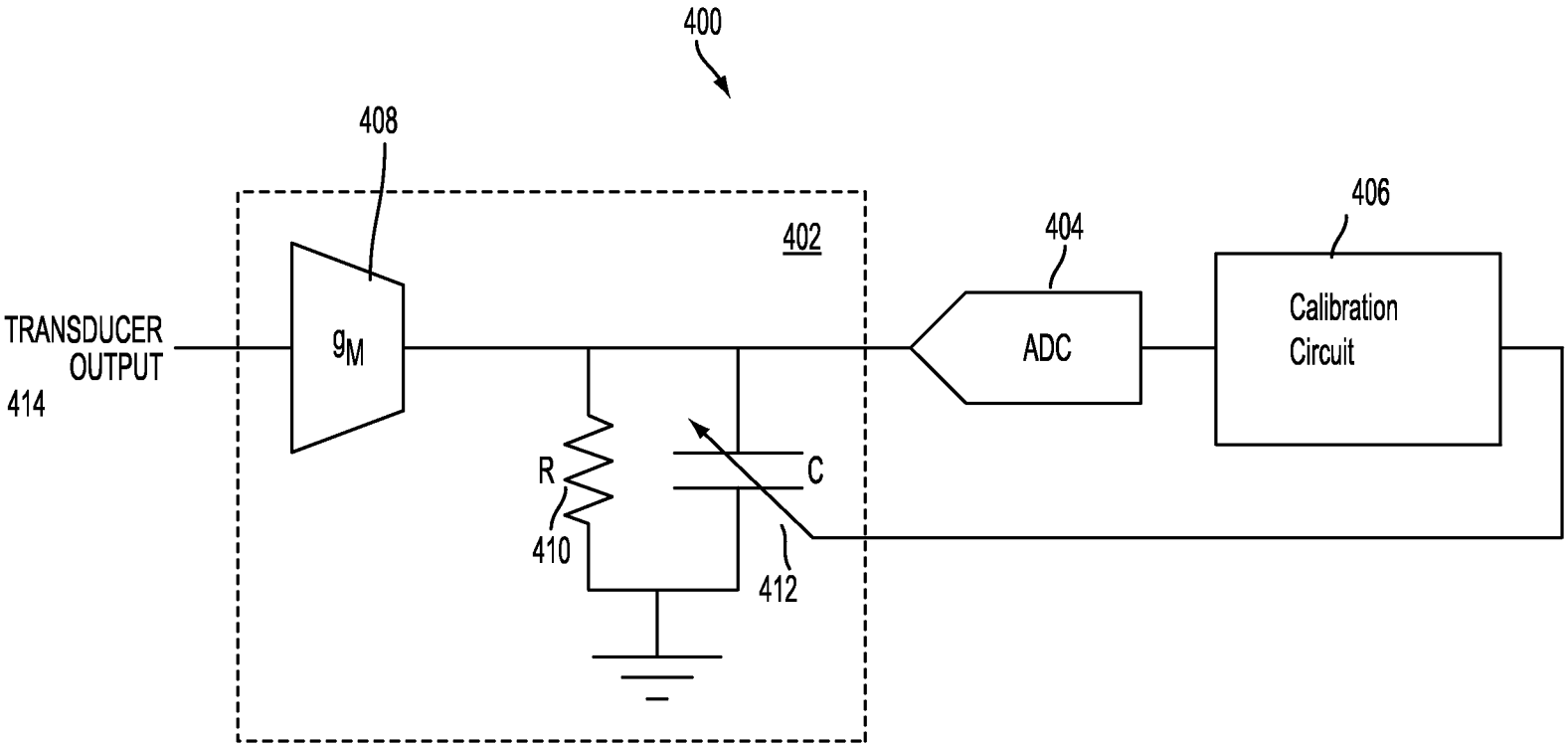
FIG. 4 shows a circuit, in accordance with another embodiment of the invention.

FIG. 4 shows a circuit 400, in accordance with another embodiment of the invention. The circuit 400 is shown to include an amplifier 402, an analog-to-digital converter (ADC) 404, and a calibration circuit 406. The amplifier 402 is shown to receive the transducer output 414 and includes a transconductance element 408, a resistor 410, and a variable capacitor 412. The amplifier 402 is shown coupled to the ADC 404, and the ADC 404 is further shown coupled to the calibration circuit 406, which is shown coupled to the capacitor 412 of the amplifier 402. The transconductance element 408 is shown coupled to the resistor 410 and the capacitor 412. Opposite ends of the resistor 410 and capacitor 412 are shown coupled to ground.

The resistor 410 and capacitor 412 act as an adaptive filter with a parameter, such as the capacitance of the capacitor 412, changed by the calibration circuit 406. The transconductance element 408 converts the output 414 to current and provides the current to the filter made of the resistor-capacitor combination of the amplifier 402. The output of the filter, which is in analog form, is converted to digital form by the ADC 404. The ADC 404 provides a digital signal to the calibration circuit 406, which uses the digital signal to adjust the resistor-capacitor filter. Varying the corner frequency response of the filter results in substantially better attenuation of the gain peak and because the filter is an adaptive filter, environmental effects on the acoustic sensor that cause a shift in the gain peak are compensated for.

In some embodiments of the invention, the calibration circuit 406 is located in the same chip as the amplifier 402, or in the same package with the amplifier 402. In other embodiments of the invention, as shown in FIG. 4, the calibration circuit 406 is located externally to the amplifier 402.

It is understood that the embodiments of FIGS. 2-4 are merely examples of filters and circuits for reducing the gain peak and that many other filters and circuits, too numerous to list, are anticipated.

Figure 5:
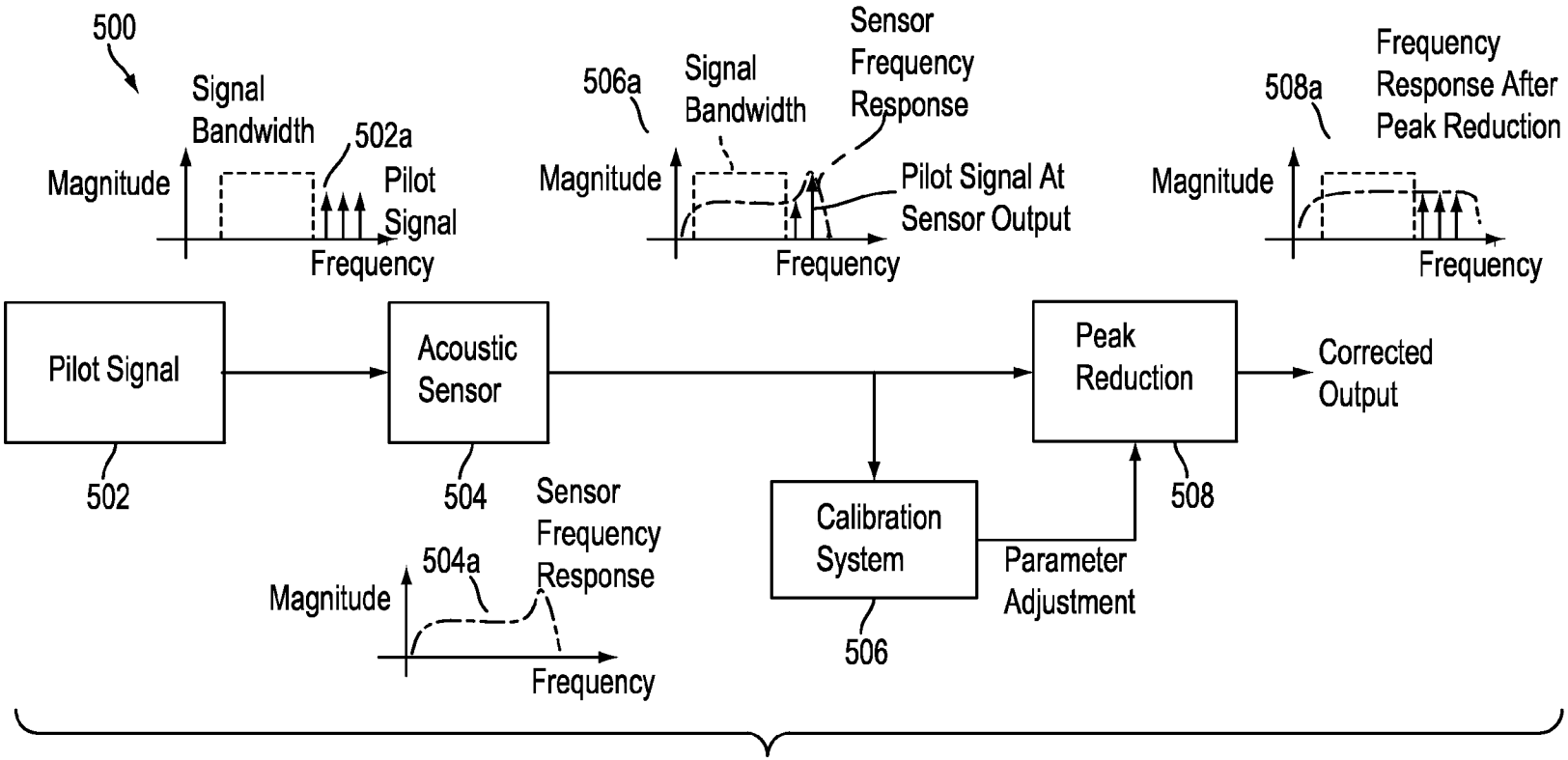
FIG. 5 shows a test system 500 of a peak reduction circuit, in an exemplary embodiment of the invention.

FIG. 5 shows a test system 500 of a peak reduction circuit, in an exemplary embodiment of the invention. In FIG. 5, next to each block, a graph of the frequency response of the output of the block is shown. In FIG. 5, a pilot signal generator 502 is shown coupled to an acoustic sensor 504, and the acoustic sensor is shown coupled to a calibration system 506 and to a peak reduction circuit 508. The calibration system 506 is shown coupled to the peak reduction circuit 508, as is the acoustic sensor 504.

The pilot signal generator 502 generates pilot signals for the acoustic sensor 504, which in an embodiment of the invention is a microphone. A graph of the pilot signal magnitude vs. frequency is depicted at 502*a*. The output of the acoustic sensor 504 has a frequency response shown by graph 504*a*. As shown in the graph 504*a*, a peak is introduced into the frequency response of graph 502*a* due to the effects of the acoustic sensor.

The calibration system 506 uses the output of the acoustic sensor 504 to calibrate the peak reduction circuit 508 by adjusting the parameters thereof. The output of the peak reduction circuit 508 is a corrected output with no peaks in its frequency response, which is shown by the graph 508*a*. Examples of the peak reduction circuit 508, without limitation, are any of the peak reduction circuits shown and discussed herein.

Although the description has been written with respect to particular embodiments thereof, these particular embodiments are merely illustrative, and not restrictive.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications may be made to adapt a particular situation or material to the essential scope and spirit.

What we claim is:

1. A Micro-Electro-Mechanical Systems (MEMS) acoustic sensor comprising:

a MEMS transducer having a mechanical resonance and having a first frequency response with a gain peak at a resonant frequency of the mechanical resonance; and a peak reduction circuit with a second frequency response and coupled to the MEMS transducer, wherein the second frequency response of the peak reduction circuit is operable to cause attenuation of the gain peak of the MEMS transducer, and wherein the peak reduction circuit comprises a filter with at least one adjustable parameter operable to compensate for shifts in the gain peak.

2. The MEMS acoustic sensor of claim 1, wherein the filter comprises one of an analog or digital filter.

3. The MEMS acoustic sensor of claim 2, wherein the filter is adaptive.

4. The MEMS acoustic sensor of claim 3, wherein the filter and the MEMS transducer are in multiple packages.

5. The MEMS acoustic sensor of claim 3, wherein the filter and the MEMS transducer are in a single chip.

6. The MEMS acoustic sensor of claim 2, wherein the filter is non-adaptive.

7. The MEMS acoustic sensor of claim 6, wherein the filter and the MEMS transducer are in a single package.

8. The MEMS acoustic sensor of claim 1, wherein the filter comprises:

a bandpass filter, a stop-band filter, an adaptive filter, or a high-pass filter.

9. The MEMS acoustic sensor of claim 1, wherein the filter comprises a low pass filter.

10. The MEMS acoustic sensor of claim 1, wherein the calibration circuit is located in a first chip and the MEMS transducer is located in a second chip.

11. The MEMS acoustic sensor of claim 1, further comprising a calibrating circuit operable to adjust the at least one adjustable parameter.

12. The MEMS acoustic sensor of claim 1, wherein calibration circuit is located in a separate package from the MEMS transducer.

13. The MEMS acoustic sensor of claim 1, further comprising an internal calibration circuit operable to adjust the at least one adjustable parameter.

14. The MEMS acoustic sensor of claim 1, wherein the peak reduction circuit comprises an active damping circuit.

15. The MEMS acoustic sensor of claim 14, wherein the active damping circuit is adaptive.

16. The MEMS acoustic sensor of claim 15, wherein the active damping circuit has at least one parameter, and wherein the MEMS acoustic sensor further comprises a calibration circuit operable to adjust the at least one parameter.

17. The MEMS acoustic sensor of claim 15, wherein the active damping circuit further includes a feedback loop operable to apply a dampening force to the MEMS transducer to reduce the gain peak.

18. The MEMS acoustic sensor of claim 16, wherein the calibration circuit is located in one chip and the MEMS transducer is located in another chip.

19. The MEMS acoustic sensor of claim 16, wherein the calibration circuit is located in a first package and the MEMS transducer is located in a second package.

20. The MEMS acoustic sensor of claim 16, further comprising an internal calibration circuit operable to adjust the at least one parameter.

21. The MEMS acoustic sensor of claim 1, wherein the MEMS acoustic sensor is configured as a microphone.

22. A method of attenuating a gain peak of a first frequency response of a Micro-Electro-Mechanical Systems (MEMS) transducer having a mechanical resonance at a gain peak frequency of a MEMS acoustic sensor comprising:

receiving signals from the MEMS transducer at a peak reduction circuit coupled to the MEMS transducer, wherein the peak reduction circuit has a bandwidth and a second frequency response;

adjusting parameters of a filter associated with the peak reduction circuit to compensate for shifts in the gain peak; and attenuating the gain peak by reducing the bandwidth of the peak reduction circuit below the gain peak frequency of the MEMS transducer.

23. The method of attenuating of claim 22, wherein adjusting parameters includes adjusting parameters upon a first power-on of the MEMS acoustic sensor.

24. The method of attenuating of claim 23, wherein adjusting parameters includes adjusting parameters upon a subsequent power-on of the MEMS acoustic sensor.

25. The method of attenuating of claim 22, wherein adjusting parameters includes continuously adjusting parameters while the MEMS acoustic sensor is powered on.

* * * * *